US012276105B2

(12) United States Patent
Leitch et al.

(10) Patent No.: US 12,276,105 B2
(45) **Date of Patent: *Apr. 15, 2025**

(54) ROOFING SHINGLES WITH A PLURALITY OF INDENTATIONS

(71) Applicant: BMIC LLC, Dallas, TX (US)

(72) Inventors: Olan T. Leitch, Mt. Juliet, TN (US); Timothy H. Lock, Ennis, TX (US)

(73) Assignee: BMIC LLC, Dallas, TX (US)

( * ) Notice: Subject to any disclaimer, the term of this patent is extended or adjusted under 35 U.S.C. 154(b) by 49 days.

This patent is subject to a terminal disclaimer.

(21) Appl. No.: 17/893,286

(22) Filed: Aug. 23, 2022

(65) Prior Publication Data

US 2023/0069674 A1 Mar. 2, 2023

Related U.S. Application Data

(60) Provisional application No. 63/237,172, filed on Aug. 26, 2021.

(51) Int. Cl.

| | |
|---|---|
| ***E04D 1/26*** | (2006.01) |
| ***E04D 1/12*** | (2006.01) |
| ***E04D 1/28*** | (2006.01) |

(52) U.S. Cl.

CPC ..... *E04D 1/26* (2013.01); *E04D 1/125* (2013.01); *E04D 1/28* (2013.01)

(58) Field of Classification Search

CPC ..... E04D 1/26; E04D 1/125; E04D 1/28; E04D 1/2907

See application file for complete search history.

(56) References Cited

U.S. PATENT DOCUMENTS

| | | | | |
|---|---|---|---|---|
| 3,138,897 | A | 6/1964 | McCorkle | |
| 3,190,040 | A | 6/1965 | Theobald | |
| 3,252,257 | A | 5/1966 | Price et al. | |
| 3,607,529 | A * | 9/1971 | Chalmers | E04D 1/28 156/291 |
| 4,738,884 | A | 4/1988 | Algrim et al. | |
| 5,394,672 | A | 3/1995 | Seem | |
| 5,950,387 | A | 9/1999 | Stahl et al. | |
| 6,471,812 | B1 | 10/2002 | Thompson et al. | |
| 6,813,866 | B2 | 11/2004 | Naipawer, III | |
| 6,968,662 | B2 | 11/2005 | Rodrigues | |
| 7,219,476 | B2 | 5/2007 | Akins et al. | |
| 7,320,767 | B2 | 1/2008 | Edge et al. | |
| 7,833,371 | B2 | 11/2010 | Binkley et al. | |

(Continued)

FOREIGN PATENT DOCUMENTS

EP 3115524 A1 1/2017

*Primary Examiner* — Adriana Figueroa

(74) *Attorney, Agent, or Firm* — GREENBERG TRAURIG, LLP

(57) ABSTRACT

Roofing shingles are disclosed that are capable of being attached to a roof deck, underlayment, and/or other roofing shingles and that require few mechanical fasteners to remain attached to the roof. The roofing shingles are formed with a first layer and a second layer of shingle materials that are laminated together, and with the first and second layers further being mechanically attached with indentations in the first and second layers at spaced locations along and across the roofing shingles. A roofing system comprising a plurality of courses of the roofing shingles is also disclosed.

22 Claims, 7 Drawing Sheets

(56) References Cited

U.S. PATENT DOCUMENTS

| | | | | |
|---|---|---|---|---|
| 8,006,457 | B2 * | 8/2011 | Binkley | E04D 1/26 52/557 |
| 8,127,514 | B2 | 3/2012 | Binkley et al. | |
| 8,240,100 | B2 * | 8/2012 | Kalkanoglu | E04D 1/26 52/518 |
| 8,297,020 | B1 | 10/2012 | Swanson | |
| 8,302,358 | B2 | 11/2012 | Kalbanoglu | |
| 8,316,608 | B2 | 11/2012 | Binkley et al. | |
| 8,535,786 | B2 | 9/2013 | Schroer et al. | |
| 8,863,388 | B2 | 10/2014 | Aschoff et al. | |
| 8,984,835 | B2 * | 3/2015 | Kalkanoglu | B32B 38/10 52/557 |
| 9,057,194 | B2 | 6/2015 | Jenkins et al. | |
| 9,157,236 | B2 | 10/2015 | Jenkins | |
| 9,458,633 | B2 | 10/2016 | McGraw et al. | |
| 9,540,821 | B2 | 1/2017 | Houchin et al. | |
| 9,739,062 | B2 | 8/2017 | Leitch | |
| 9,758,970 | B2 | 9/2017 | Grubka et al. | |
| 9,890,540 | B2 | 2/2018 | Weitzer | |
| 10,180,001 | B2 | 1/2019 | Leitch | |
| 11,352,792 | B2 * | 6/2022 | Boss | E04D 1/20 |
| 2003/0124292 | A1 | 7/2003 | Unterreiter | |
| 2005/0178428 | A1 | 8/2005 | Laaly et al. | |
| 2006/0269713 | A1 | 11/2006 | Zuege et al. | |
| 2009/0139175 | A1 | 6/2009 | Todd et al. | |
| 2009/0220720 | A1 | 9/2009 | Mahseen et al. | |
| 2010/0173110 | A1 | 7/2010 | Wiercinski et al. | |
| 2011/0041446 | A1 | 2/2011 | Stephens et al. | |
| 2011/0086214 | A1 | 4/2011 | Rockwell | |
| 2012/0047838 | A1 | 3/2012 | Kalkanoglu et al. | |
| 2013/0025225 | A1 | 1/2013 | Vermilion et al. | |
| 2013/0068279 | A1 | 3/2013 | Buller et al. | |
| 2014/0147611 | A1 | 5/2014 | Ackerman, Jr. | |
| 2014/0283468 | A1 | 9/2014 | Weitzer | |
| 2015/0089895 | A1 | 4/2015 | Leitch | |
| 2015/0176282 | A1 | 6/2015 | Baker | |
| 2017/0314271 | A1 | 11/2017 | Sutton et al. | |
| 2018/0038108 | A1 | 2/2018 | Aschenbeck et al. | |
| 2021/0108416 | A1 | 4/2021 | Aschenbeck et al. | |

* cited by examiner

ROOFING SHINGLES WITH A PLURALITY OF INDENTATIONS

REFERENCE TO RELATED APPLICATION

The present Patent application claims the benefit of U.S. Provisional Application No. 63/237,172, filed Aug. 26, 2021.

INCORPORATION BY REFERENCE

The disclosures made in United States Provisional Patent Application No. 63/237,172, filed Aug. 26, 2021, are specifically incorporated by reference herein as if set forth in their entirety.

TECHNICAL FIELD

This disclosure relates to roofing shingles, and in particular to roofing shingles and methods of forming roofing shingles comprising a plurality of layers, that can be connected by a combination of indentations and adhesive. The present disclosure also relates to roofing systems that utilize the roofing shingles.

BACKGROUND

Roofing shingles typically are attached to a roof deck with mechanical fasteners such as nails or staples. Such mechanical fasteners prevent wind uplift of the shingles, and can help increase slump performance and improve the stability of the installed shingles so that they may be safely walked upon by roofers. Mechanical fasteners, however, physically penetrate the shingles and the roof deck therebelow, and therefore act as potential leak points for water. Moreover, as a roof ages, the fasteners may corrode, increasing the risk of water entry and loss of shingle anchoring. The need for mechanical fasteners also increases installation time and cost given the volume of fasteners (e.g., nails) that are required to secure all of the shingles to a roof. Furthermore, some shingle designs require that the fasteners are driven through specific locations of the shingle area. For example, in the case of laminated shingles having a backer strip adhered to an upper layer, the fasteners generally must be placed in a common bond area where the two layers are attached to one another across the length of the shingle, which is known as the nail zone. Typically, the nail zone is relatively narrow, thus requiring the roofer to pay careful attention to the positioning of the fasteners. Installation of laminated shingles could thus be rendered easier and faster if the roofer had more flexibility in where to position the fasteners, and if substantially fewer fasteners were needed for a roof installation.

Accordingly, it can be seen that a need exists for roofing shingles with increased strengthening of the connection between the layers thereof, and which can reduce the number of mechanical fasteners required for a roof installation. The present disclosure addresses these and other related and unrelated issues.

SUMMARY

Briefly described, according to aspects of the present disclosure, a roofing shingle and methods of making roofing shingles are provided. In embodiments, the roofing shingle comprises a first layer and a second layer opposite the first layer. The first layer may be considered an upper layer of a roofing shingle, while the second layer may be considered a backer or backer layer. In embodiments, the second layer can form a lower layer of the roofing shingle including a lower surface. The first layer can include a headlap portion and an exposure portion. The headlap portion is configured to be overlapped by at least one additional roofing shingle arranged in a next higher course of roofing shingles. In embodiments, the exposure portion of the first layer further can include a plurality of tabs or teeth. In embodiments, a plurality of indentations are formed in the first layer and the second layer of the roofing shingle. The plurality of indentations can be configured and/or applied in such a way to form mechanical attachments configured to attach the second layer to the first layer.

In some embodiments, at least a first portion or plurality of the plurality of indentations are formed in registration with a common bond area along which the second layer and the first layer are attached together. In embodiments, at least a second portion or plurality of the plurality of indentations further can be formed in registration with the plurality of tabs of the exposure portion of the first layer.

In embodiments, an adhesive, e.g., an adhesive line, strip, bead, dots, or combination thereof, can be applied between the first layer and second layer along the common bond area, and also can be applied at locations spaced along the plurality of tabs. In some embodiments, at least a first portion of the plurality of indentations formed in the first layer and second layer can be formed in registration with the common bond area and the adhesive applied therealong. At least some of these indentations can project through the adhesive at the common bond area.

In embodiments, a second portion of the plurality of indentations can be formed along the second layer opposite the tabs of the first layer, and can be formed in registration with and can project through the adhesive strips or dots arranged along the second layer opposite the plurality of tabs. In some embodiments, at least some of the indentations of the second portion of the plurality of indentations formed in the first layer and second layer also can project through areas of the second layer opposite the plurality of tabs where there is no adhesive.

In other embodiments, a roofing shingle is provided that is configured such that attachment of the first and second layers thereof can utilize less adhesive than a roofing shingle with no indentations or a roofing shingle with indentations only in the common bond area. The indentations at the plurality of tabs can be applied in a machine direction and/or can be applied in a cross-machine direction. In embodiments, the indentions can be of a depth such that the indentations are visible, or not visible, along the exposure portion of the plurality of tabs and/or common bond area; and in some embodiments, if the indentions are formed so as to be visible, the indentations can be arranged or shaped to form aesthetic features. Further, the indentations can, when applied, cause a substantially complete fusion between the backer and the shingle. The resulting roofing shingle can exhibit improved resistance to parallel and perpendicular forces in relation to the roofing shingle, an increased slump performance, and an improved angle shear resistance.

According to aspects of the present disclosure, a roofing shingle comprises a first layer comprising a headlap portion configured to be overlapped by at least one additional roofing shingle arranged in a next higher course of roofing shingles; and an exposure portion having a plurality of tabs; a second layer opposite the first layer; and a plurality of indentations formed in the first and second layers of the roofing shingle; wherein the plurality indentations are configured to attach the first and second layers; and wherein at least a portion of the plurality of indentations are formed in registration with the plurality of tabs of the exposure portion of the first layer.

In embodiments of the roofing shingle, the plurality of indentations comprises a first plurality of indentations formed along the first layer and the second layer in a machine direction and in registration with a common bond area between the first layer and the second layer; and a second plurality of indentations formed along the first layer and the second layer in the machine direction; and wherein the first plurality of indentations and the second plurality of indentations are arranged at spaced positions in a cross-machine direction across the first layer and the second layer.

In some embodiments of the roofing shingle, a portion of the plurality of indentations formed in the first and second layers of the roofing shingle comprise a circular, square, triangular, rectangular, diamond, star, or hemispherical geometry, or combination thereof.

In some embodiments of the roofing shingle, a portion of the plurality of indentations formed in the first and second layers of the roofing shingle are configured to form raised areas along the plurality of tabs of the exposure portion to define a plurality of aesthetic features along the exposure portion.

In embodiments, the roofing shingle further comprises at least one strip of adhesive applied between the first layer and the second layer along a common bond area, and at least one additional strip of adhesive applied between the second layer and the plurality of tabs of the exposure portion of the first layer, and wherein at least some of the portion of the plurality of indentations formed in the first and second layers project through the at least one additional strip of adhesive.

In some embodiments, an additional portion of the plurality of indentations formed in the first and second layers of the roofing substrate can be configured to extend through the at least one strip of adhesive between the first and second layers along the common bond area.

According to other aspects of the disclosure, a method comprises moving a substrate of roofing shingle material along a path in a machine direction, the substrate comprising a first layer and a second layer; wherein the first layer comprises a headlap portion, and an exposure portion having a plurality of tabs; forming a first plurality of indentations in the substrate in the machine direction, the first plurality of indentations configured to attach the first layer to the second layer; forming a second plurality of indentations in the substrate in the machine direction; wherein the second plurality of indentations are spaced from the first plurality of indentations across the substrate in a cross-machine direction, and wherein at least some of the second plurality of indentations are positioned in registration with the plurality of tabs formed in the first layer of the substrate; and cutting the substrate to form a plurality of roofing shingles.

In embodiments of the method, forming the second plurality of indentations in the substrate comprises punching circular, square, rectangular, diamond shaped, triangular shaped, or star-shaped indentations, or a combination thereof, into the substrate.

In embodiments of the method, forming the second plurality of indentations further comprises punching at least some indentations of the second plurality of indentations into the substrate to a depth sufficient to form raised areas that are visible along an upper surface of the plurality of tabs of the first layer.

In embodiments of the method, forming the plurality of tabs in the first layer comprises engaging the first layer with a cutter and cutting portions of the first layer to form the plurality of tabs; and wherein forming the second plurality of indentations comprises engaging the second layer of the substrate with a plurality of punches, wherein the plurality of punches are moved in registration with the cutter to form the second plurality of indentations in registration with the plurality of tabs.

In embodiments of the method, forming the first plurality of indentations and forming the second plurality of indentations comprises engaging the substrate with a plurality of punches; wherein forming the first plurality of indentations further comprises punching the first plurality of indentations though a strip of adhesive material positioned along a common bond area between the first layer and second layer; and wherein forming the second plurality of indentations comprises punching at least some of the second plurality of indentations through at least one additional strip of an adhesive material positioned between the plurality of tabs of the first layer and the second layer.

In embodiments, the method, forming the first plurality of indentations and forming the second plurality of indentations comprises engaging the substrate with a plurality of punches, and forming at least a portion of at least one of the first plurality of indentions and the second plurality of indentions in the substrate between a strip of adhesive material positioned along a common bond area between the first layer and second layer and at least one additional strip of an adhesive material positioned between the plurality of tabs of the first layer and the second layer.

According to other aspects of the disclosure, a stack of roofing shingles comprises a plurality of roofing shingles, wherein at least a portion of the roofing shingles comprises a first layer including an upper surface having a headlap portion configured to be overlapped by at least one additional roofing shingle arranged in a next higher course of roofing shingles on a roof, and an exposure portion having a plurality of tabs; a second layer opposite the first layer; and a plurality of indentations formed in the first and second layers and configured to attach the first and second layers together, the plurality of indentations comprising a first plurality of indentations formed in a machine direction; and a second plurality of indentations formed along each roofing shingle in the machine direction and spaced from the first plurality of indentations in a cross-machine direction; and wherein at least a portion of the second plurality of indentations are located in registration with the plurality of tabs of the exposure portion.

In embodiments, the one or more of the plurality of indentations formed in the first and second layers in registration with the plurality of tabs of the exposure portion are configured to form raised areas along the plurality of tabs of the exposure portion; wherein at least a portion of the raised areas define a plurality of aesthetic features visible along the exposure portion.

In embodiments, the plurality of indentations formed in the first and second layers comprise a circular, square, triangular, rectangular, diamond, star, or hemispherical geometry, or a combination thereof.

In embodiments, further comprising at least one strip of adhesive applied between the first layer second layers along a common bond area between the first and second layers, and at least one additional strip of adhesive applied between the second layer and the plurality of tabs of the exposure portion of the first layer; wherein at least a portion of the plurality of indentations formed in the first and second layers project through the at least one additional strip of adhesive.

In embodiments, an additional portion of the plurality of indentations formed in the first and second layers are configured to extend through the at least one strip of adhesive applied between the first and second layers along the common bond area.

According to other aspects of the disclosure, a roofing system is provided, comprising a roof deck, a plurality of roofing shingles positioned on the roof deck, wherein at least a portion of the roofing shingles comprises a first layer having a headlap portion and an exposure portion having a plurality of tabs, a second layer attached to the first layer; and a plurality of indentations aligned in a machine direction along the first layer and second layer, the plurality of indentations configured to attach the first layer to the second layer; wherein a first plurality of indentations of the plurality of indentations are positioned in registration with a common bond area between the first and second layers; wherein a second plurality of indentations of the plurality of indentations are spaced from the first plurality of indentations in a cross-machine direction across the first layer and second layer and are positioned in registration with the plurality of tabs of the exposure portion of the first layer; and wherein the roofing shingles are arranged in overlapping courses of roofing shingles on the roof deck with the headlap portion of each roofing shingle in a lower course attached to an overlapping roofing shingle of a higher course of roofing shingles.

In embodiments of the roofing system, the plurality of indentations formed in the first and second layers comprise a circular, square, triangular, rectangular, diamond, star, or hemispherical geometry, or a combination thereof.

In embodiments, the roofing system further comprises at least one strip of adhesive applied between the first layer second layers along a common bond area between the first and second layers, and at least one additional strip of adhesive applied between the second layer and the plurality of tabs of the exposure portion of the first layer; wherein at least a portion of the plurality of indentations formed in the first and second layers project through the at least one additional strip of adhesive.

In embodiments of the roofing system, the one or more of the plurality of indentations formed in the first and second layers in registration with the plurality of tabs of the exposure portion are configured to form raised areas along the plurality of tabs of the exposure portion; wherein at least a portion of the raised areas define a plurality of aesthetic features visible along the exposure portion.

In embodiments of the roofing system, an additional portion of the plurality of indentations formed in the first and second layers are configured to extend through at least one strip of adhesive applied between the first and second layers along the common bond area.

Accordingly, embodiments of roofing shingles, roofing systems and methods for forming roofing shingles that are directed to the above discussed and other needs are disclosed. The foregoing and other advantages and aspects of the present disclosure will become apparent and more readily appreciated from the following detailed description, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

Embodiments of roofing shingles, roofing systems, and methods of forming roofing shingles, according to principles of the present disclosure will be described below in more detail with reference to the attached drawing figures.

Figure 3A:
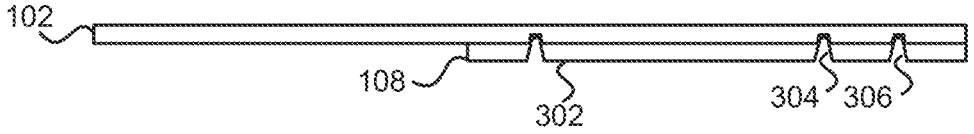
FIG. 3A and FIG. 3B show a side view of various roofing shingles according to embodiments of the present disclosure.
Figure 3B:
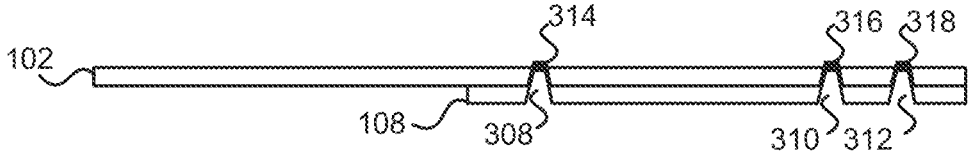
Figure 4A:
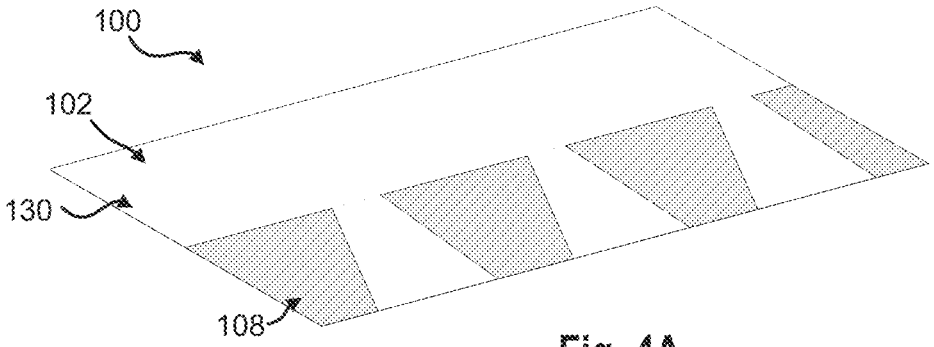
FIG. 4A and FIG. 4B show a perspective view of top side and bottom side surfaces of a roofing shingle according to embodiments of the disclosure
Figure 4B:
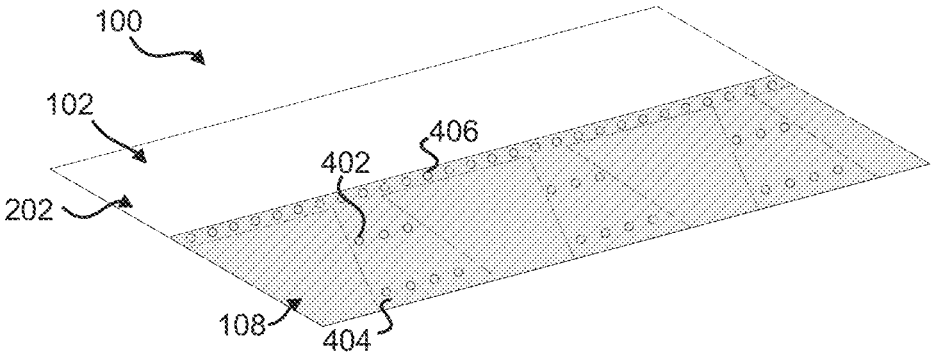
Figure 5:
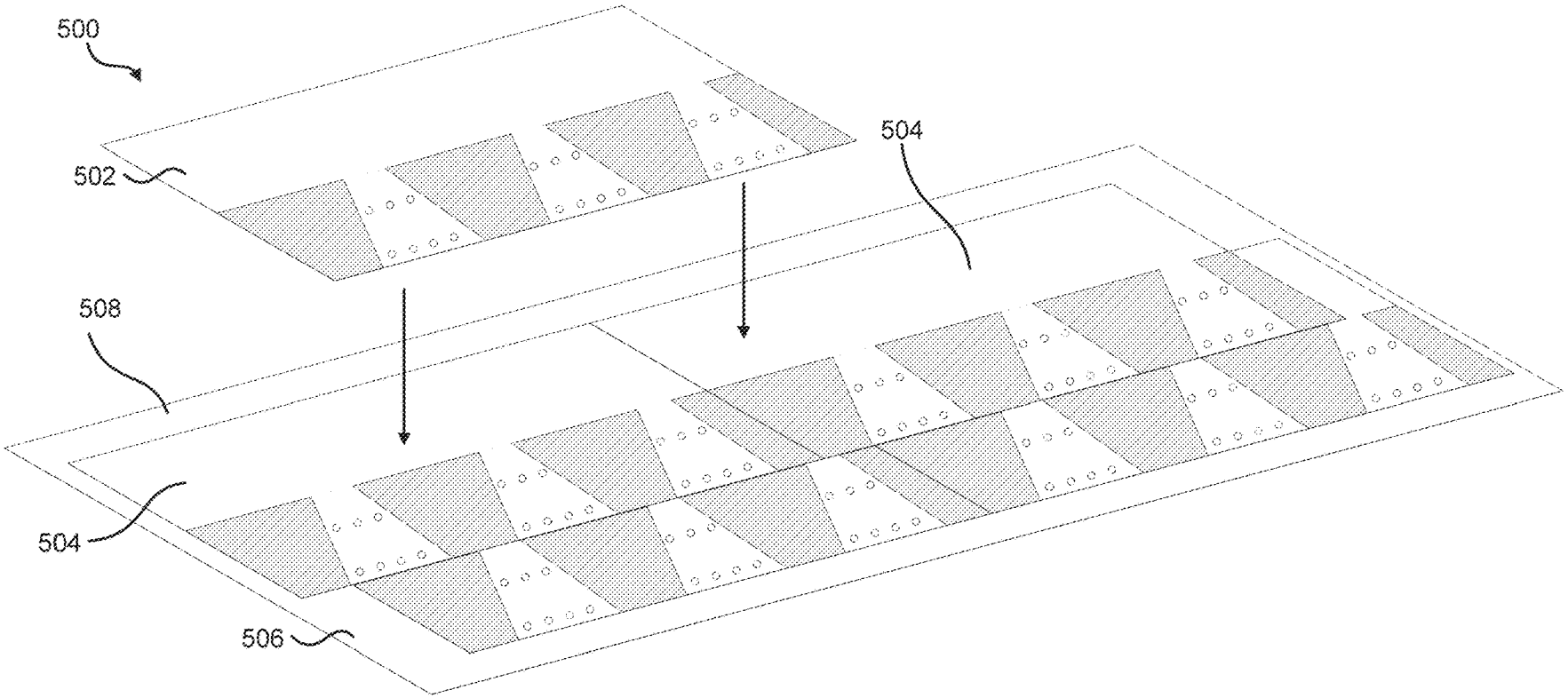
FIG. 5 shows a roofing system according to an embodiment of the present disclosure.

Embodiments of roofing shingles are described herein and illustrated in FIGS. 1A-5 that are configured to withstand forces applied in a perpendicular and parallel directions in relation to the roofing shingle. Additionally, the roofing shingle is configured to exhibit improved slump performance and improved angle shear resistance. In embodiments as illustrated in FIGS. 1A-4B, the roofing shingle 100 can include a first layer 102 and a second layer 108 formed from shingle materials, such as asphalt roofing shingle materials. In embodiments, the first layer 102 comprises an exposure portion 132 and a headlap portion 104. The headlap portion 104 will be configured to be overlapped by at least one additional roofing shingle arranged in a next higher course of roofing shingles (as illustrated in FIG. 5). The exposure portion 132 of the first layer is configured to be exposed after installation of the roofing shingle 100 on a roof deck, and will include the visible portion of the roofing shingle along the roof. In embodiments, the exposure portion 132 can have a plurality of tabs or teeth 112. The second layer will have a first surface or portion 138 and a second surface portion 136, which can define a lower facing or bottom side surface of the roofing shingle. In addition, the first layer includes a front surface or portion 130 and a rear surface or portion 202 (FIG. 2A).

Figure 1A:
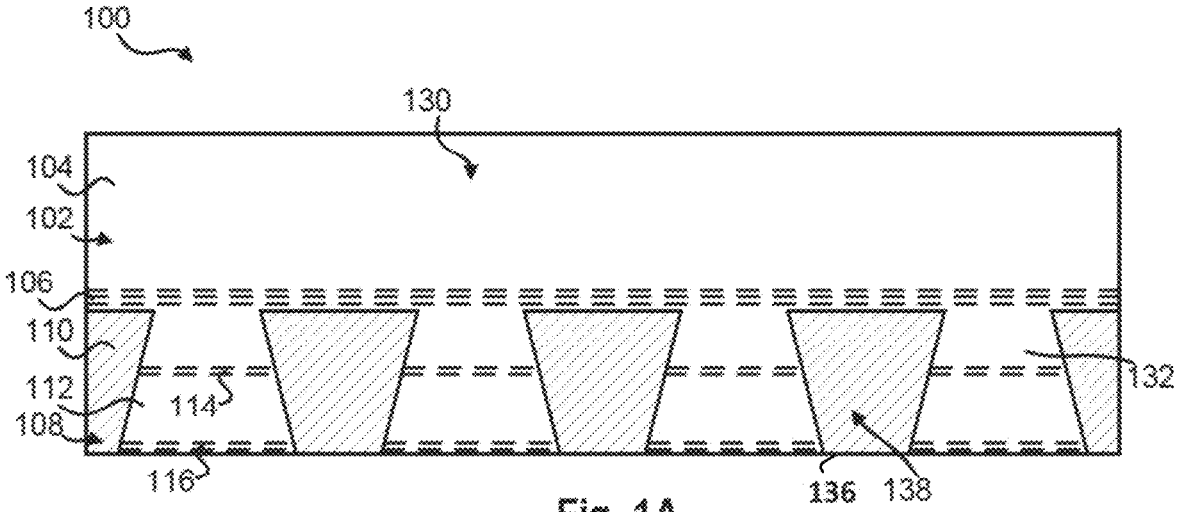
FIG. 1A, FIG. 1B, FIG. 1C, FIG. 1D, FIG. 1E, FIG. 1F, FIG. 1G, and FIG. 1H show a top-down view of a roofing shingle, including different configurations of indentations formed therein, according to embodiments of the present disclosure.
Figure 1B:
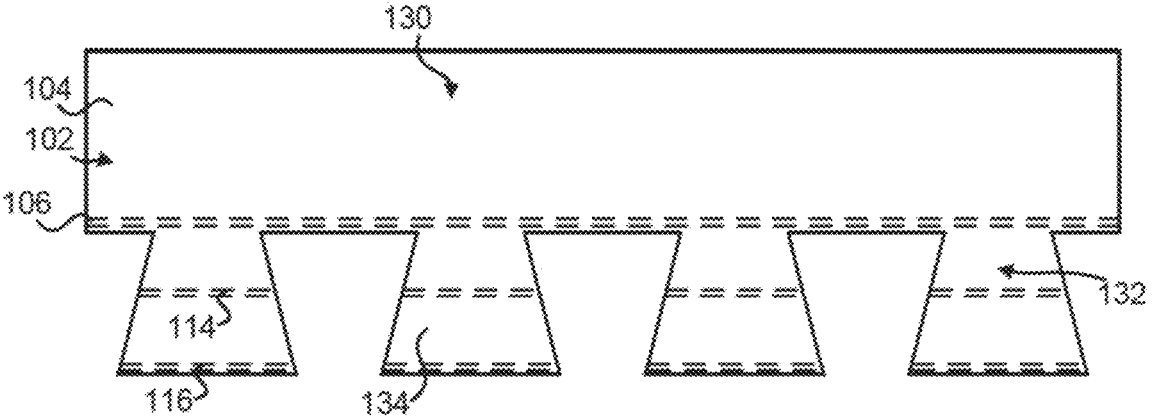

As indicated in FIG. 1A, the second layer 108 (which also can be referred to as a backer) is attached to a portion of the first layer 102, which attachment can be via application of an adhesive 106 that can be applied as an adhesive strip or dots, applied along the front surface or portion 138 of the second layer and the rear surface or portion 202 of the first layer.

In embodiments, to strengthen the connection between the first and second layers without necessarily adding additional adhesive materials therebetween, a plurality of indentations can be formed in the second layer 108. The plurality of indentations will be punched or otherwise formed in the second layer, extending therethrough, and in some embodiments, may extend into the first layer 102 to a depth configured to form mechanical attachments between the first and second layers. A first portion or first plurality of the plurality of the indentations (e.g., a first plurality of indentations) can be applied in registration with the adhesive applied along a common bond area (e.g., the indentations 118 of the first portion of the plurality of indentations can be aligned with and can be formed in registration with the adhesive strip, dashes, or dots 106 extending along an area of attachment of the first and second layers adjacent the headlap portion 104).

In embodiments, a second portion indentations of the plurality of indentations, e.g., additional indentations 120-126 (shown in FIGS. 1C and 2C) can be applied in registration with an adhesive strips, lines, beads, dots, or combinations thereof, applied along on the second layer between the second layer and the tabs of the exposure portion of the first layer and/or in other locations in registration with the plurality of tabs. For example, and without limitation, indentations 120 and 124 can be formed at locations between the strips, lines, beads, dots, or combinations thereof, of adhesive 106 applied along the common bond area, and strips, lines, beads, dots, or combinations thereof, of adhesive 114 and 116 arranged between the tabs or teeth 112 of the exposure portion and the second layer, as indicated in FIGS. 1C-1H and 2C; while other ones of the second or additional plurality of indentations 122 and 126 can be formed along and in registration with and through the strips, lines, beads, dots, or combinations thereof, of adhesives 114 and 116.

As a result, the second layer 108 may be substantially fused to the first layer 102. Furthermore, the roofing shingle 100 will be configured to withstand forces, e.g. due to wind, in parallel and perpendicular directions, e.g., in the machine and cross-machine directions with respect to the roofing shingle 100, preventing separation of the second layer 108 from the first layer 102 under such forces. Such a roofing shingle 100 also can exhibit increased slump performance, preventing separation of the second layer 108 from the first layer 102 under high temperatures. Further, the roofing shingle 100 can utilize less adhesive and, thus can cost less to produce and utilize less resources and can potentially reduce manufacturing time. As a result, a less costly, yet stronger and more resilient roofing shingle 100 is produced. In addition, with reduction of the amount of adhesive required to bond the first and second layers together sufficient to withstand high winds and other forces to resist separation of the first and second layers. The weight of the resultant roofing shingles further can be reduced, which can help reduce shipping and handling costs.

As used herein, the terms "machine direction" and "MD" mean the direction in which layers of shingle material (e.g., the first layer 102 and second layer 108) travel through a production line as it is produced or made. As used herein, the terms "cross-machine direction" and "CD" mean the direction perpendicular to the machine direction along which the material (e.g., the first layer 102 and second layer 108) travels through a production line as it is produced or made. As used herein, the term "in registration with" means in alignment along or in line with. For example, indentations applied in registration with an adhesive line of a tab means that the indentations are applied along the adhesive line.

As used herein, the term "common bond area" means the area along at which the first and second layers are attached together across the length of the roofing shingle and at which a nail zone where fasteners are to be inserted to secure the roofing shingle to a roof deck (508 in FIG. 5) as part of a roofing system is defined. The common bond area generally includes a portion of a roofing shingle 100 where the headlap portion 104 of the first layer 102 is adjacent to or overlaps a portion of the second layer 108 (as illustrated, for example, in FIGS. 2A and 2C) e.g., where the second layer is attached to the first layer 102 above the plurality of tabs 112. While additionally applied elsewhere, the adhesives and the indentations may be applied along the common bond area to provide a strong mechanical connection between the second layer 108 and the first layer 102.

Figure 1C:
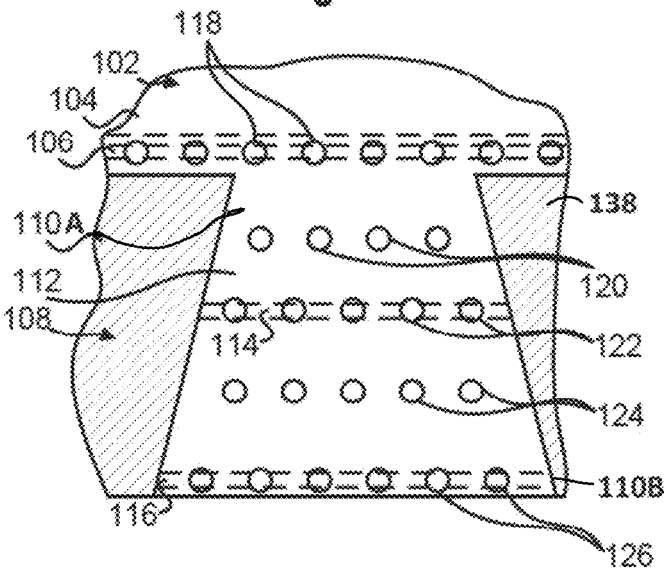

FIG. 1C illustrates a portion of the exposure portion 132 and of one of the plurality of tabs 112. As noted, the front surface 138 of the second layer 108 can attach to the rear surfaces of the first layer 102. In such examples, strips, lines, beads, dots, or combinations thereof, of various adhesives can be applied to the front surface 130 of the second layer 108 can attach to the rear surface of the first layer 102. The adhesive can include a contact adhesive, a pressure sensitive adhesive, an asphaltic adhesive, and/or other, similar bonding agent. As also noted, the common bond area further includes an adhesive strip, line, beads, dots, or combinations thereof, as indicated at 106.

In addition, an upper portion 110A and a lower portion 110B of the plurality of tabs 112 can include adhesive strips, lines, beads, dots, or combinations thereof, such as a strip, line, bead, dot, or a combination thereof, of adhesive 114 and a strip, line, bead, dot, or a combination thereof, of adhesive 116 applied therealong. Based on an amount, depth, width or diameter, shape, and/or placement of the indentations, less adhesive can be utilized. For example, rather than a continuous line or strip of adhesive, dots or discontinuous strips of adhesives can be added to the front 130 surface of the second layer 108 to attach the front of the second layer to the rear of the first layer 108.

As noted, it has been found that the use of mechanical indentations or punches in combination with an adhesive reduces slippage of the roofing shingle 100 layers during hot weather (e.g., slump resistance), meaning that fewer or no nails need to be positioned in the common bond area to hold the layers (e.g., the first layer 102 and the second layer 108) of the roofing shingle 100 together. As a result, the nail zone (e.g., where nails or other mechanical fasteners are used to connect the roofing shingle 100 to a deck or other substrate) can be wider, facilitating and speeding installation. In an embodiment, the nail zone is 0.25 inches to 1.0 inch wide, 0.25 inches to 0.875 inches wide; 0.25 inches to 0.75 inches wide; 0.25 inches to 0.5 inches wide; 0.25 inches to 0.375 inches wide; 0.375 inches to 1 inch wide; 0.375 inches to 0.875 inches wide; 0.375 inches to 0.75 inches wide; 0.375 inches to 0.5 inches wide; 0.5 inches to 1.0 inch wide, 0.5 inches to 0.875 inches wide; 0.5 inches to 0.75 inches wide; 0.75 inches to 1.0 inch wide; or 0.75 inches to 0.875 inches wide. Other widths also can be provided. Such a nail zone can be visibly marked with a fine stripe and/or one or more paint or print lines. The fine stripe further may enhance sealant bonding to the face coating for the roofing shingles. In some embodiments, the use of the second plurality of indentations 120-126 can help substantially reduce the need for the application of mechanical fasteners, enabling the use of even wider nail zones, and without requiring such fasteners be located along the common bond area.

In embodiments, the resulting roofing shingle 100 of FIGS. 1A-4B can be configured to withstand high winds or high wind uplift. Such a roofing shingle 100 can meet or exceed the requirements for wind resistance under ASTM D3161 and D7158; for example, the roofing shingles will be configured to withstand wind uplift forces generated by wind speeds of up to 110 mph (Class F under ASTM D3161), and in some embodiments, up to 155 mph (Class G under ASTM D7158) when installed on a roof deck 508 (see FIG. 5). Other tests can be utilized to test additional capabilities of the roofing shingle 100. The roofing shingle 100 further is configured to meet or exceed additional shingle performance standards pursuant to 1 CC Evaluation Services Acceptance Criteria AC438, including meeting AC438 standards for tear strength, fastener pull-through resistance, plurality, and penetration and asphalt softening; as well as weather resistance (including resistance to accelerated aging due to exposure to UV light), wind driven rain, fire resistance (e.g., in accordance with UL 790 Class C), weight of displaced surfacing.

In addition, slump performance of the roofing shingle can be determined based on various tests. For example, one test may include heating a vertically hanging roofing shingle 100 for a period of time. As some roofing shingles reach certain elevated temperatures where the adhesive softens and can lose its tack or adhesion, the first layer may separate from the second layer. The roofing shingle 100 described herein is further configured to withstand elevated or higher than normal temperatures (e.g., temperatures of 110° F. or greater) as compared to a typical roofing shingle, to maintain the connection or adhesion between the first and second layers of the roofing shingle and resist such potential to separation of the layers. In addition, with multiple lines of indentations formed along and across the roofing shingle, the resistance to separation of the layers can be improved in both the machine direction and in the cross-machine direction.

Figure 6:
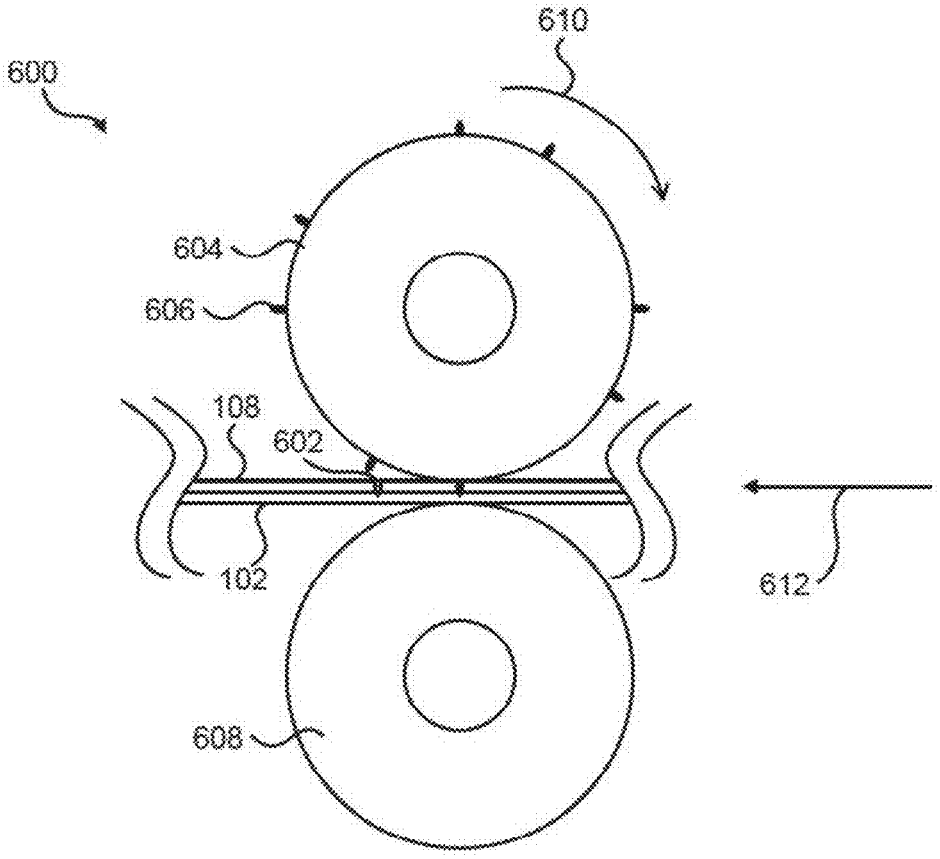
FIG. 6 shows an indentation cylinder with a plurality of punches for forming the indentations in registration with the tabs of roofing shingles according to an embodiment of the present disclosure.

In an embodiment, mechanical attachments between the layers (e.g., the first layer 102 and the second layer 108) are formed by the plurality of indentations 118, 120, 122, 124, and 126 (also referred to as punches) in which one layer (e.g., second layer 108) of the roofing shingle 100 is partially punched or pressed to form the indentations at a depth sufficient to extend into the other layer (e.g., the first layer 102) and thus create the mechanical attachments therebetween. Preferably, the indentations are made on the back side of the roofing shingle 100, and, in embodiments, will be made in the area where adhesive 106 is applied along the common bond area, and in areas where the strips, lines, beads, dots, or combinations thereof, of adhesive 114 are applied between the second layer and the plurality of tabs 112, and also can be formed where no laminating adhesive is applied between the second layer and the plurality of tabs 112, such as indicated in FIGS. 1C-1H. The process of applying the indentations can be performed shortly after application of the adhesives 106 and 114 and adhesion of the first and second layers together as the layers are moved along a processing path of a laminating line. The force of the indentation can allow the still flowable adhesive to penetrate more deeply between the layers. In a preferred embodiment, the indentations are created by an indentation cylinder, as shown in FIG. 6

FIGS. 1A-4B show various perspectives of a roofing shingle 100. FIGS. 1A and 1B illustrate a front surface or portion 130 of a roofing shingle 100, showing the headlap portion 104 or area and an exposure portion 132 or area of the first layer 102. The headlap portion 104 can be configured such that the exposure portion of another roofing shingle can be placed and installed over the headlap portion 104, with the rear surface of the other roofing shingle (e.g., a roofing shingle of a higher course of roofing shingles) overlapping and engaging the headlap portion as indicated in FIG. 5). As such, in embodiments as shown in FIGS. 1A-1C, the rear of the first layer 108 below the headlap portion 104 can include strips, dots, or beads of adhesive. The front of the exposure portion 132 of the first layer also can include a plurality of tabs 112 which can also be referred to as teeth or dragon teeth. The first layer 102 can be comprised of asphalt or other suitable materials for forming a roofing shingle. The adhesive can include a contact adhesive, a pressure sensitive adhesive, an asphaltic adhesive, and/or other, similar bonding agent.

FIGS. 1A-4B illustrate the second layer 108, including portions of the second layer 108 that are covered by the headlap portion 104 and the plurality of tabs 112 of the first layer. The second layer 108 can be comprised of the same or a different material as the first layer 102. For example, conventional shingle materials for formation of asphalt shingles can be used. In embodiments, the first layer 102 can be of a different shade or color than the second layer 108 for creating visual aesthetics or features due to the contrast in color. The front surface 130 of the second layer 108 can be connected to or attached to the rear surface of the first layer 102 by the combination of the adhesives and indentations.

The indentations 118, 120, 122, 124, and 126 applied to the second layer 108 and the first layer 102 can be of a variety of shapes. As illustrated in FIG. 1C, in some embodiments, the indentations may be circular, at least a first portion of the plurality of indentations, e.g. a first plurality of indentations 118, can be applied in registration with the adhesive strips, lines, beads, dots, or combinations thereof, 106 extending along the common bond area between the first and second layers, while another, second portion of the plurality of indentations, e.g. at least a portion of a second plurality of indentations 122 and 126, can be applied in registration with adhesive strips, lines, beads, dots, or combinations thereof, as indicated at 114 and 116, respectively applied between the second layer and the tabs of the exposure portion of the first layer. Other ones of the indentations (e.g., indentations 120, 124) can be applied at various other positions, such as at an upper portion 110A (FIG. 1C) or a lower portion 110B of the plurality of tabs 112, being applied in registration with the tabs, but not along the adhesive strips, lines, beads, dots, or combinations thereof, as indicated at 114. In addition, a number of indentations of a particular size are illustrated in FIG. 1C, however, it will be understood that the number and size of the indentations can vary, e.g., larger or smaller indentations, more or less indentations, and/or indentations applied in differing locations.

In an embodiment, the depth (e.g., a punch or indentation depth) of the indentations is 0.1 inches to 0.25 inches, 0.1 inches to 0.2 inches; 0.11 inches to 0.18 inches; 0.12 inches to 0.16 inches, 0.13 inches to 0.15 inches. In an embodiment, the depth of the indentations is 0.125 inches. In embodiments, the depth of the indentations can be less than 90% of the thickness of the common bond area; less from 80% of the thickness of the common bond area; less from 70% of the thickness of the common bond area; less than 60% of the thickness of the common bond area; or less than 50% of the thickness of the common bond area. Other thicknesses also can be used.

In embodiments, the length (e.g., a punch or indentation length) of the indentations is 0.05 inches to 0.15 inches; 0.05 inches to 0.125 inches; 0.05 inches to 0.10 inches; 0.05 inches to 0.015 inches; 0.075 inches to 0.15 inches; 0.075 inches to 0.125 inches; 0.075 inches to 0.10 inches; 0.1 inches to 0.15 inches; 0.1 inches to 0.125 inches. Other indention depths also can be provided.

In an embodiment, the width (e.g., punch or indentation width) of the indentations is 0.1 inches to 1 inch; 0.1 inches to 0.75 inches; 0.1 inches to 0.5 inches; 0.1 inches to 0.25 inches; 0.2 inches to 1 inch; 0.2 inches to 0.75 inches; 0.2 inches to 0.5 inches; or 0.2 inches to 0.3 inches. In an embodiment, the width of the indentations is 0.25 inches. Other indention widths, lengths or other dimensions also can be provided.

In some embodiments, the radius (e.g., a punch or indentation radius) of a rounded portion of the indentations is 0.05 inches to 0.7 inches; 0.05 inches to 0.5 inches; 0.05 inches to 0.3 inches; 0.05 inches to 0.2 inches; 0.05 inches to 0.15 inches; 0.1 inches to 0.7 inches; 0.1 inches to 0.5 inches; 0.1 inches to 0.3 inches; 0.1 inches to 0.2 inches; or 0.1 inches to 0.15 inches; 0.2 inches to 0.7; 0.2 inches to 0.5 inches; 0.2 inches to 0.3 inches; 0.2 inches to 0.15 inches; or 0.3 inches to 0.7 inches; 0.3 inches to 0.5 inches; 0.3 inches to 0.2 inches; or 0.3 inches to 0.15 inches. In an embodiment, the radius of the rounded portion of the indentations is 0.125 inches. Other indention radii also can be provided.

In an embodiment, the spacing (e.g., punch or indentation spacing) of the indentations is 0.1 inches to 5 inches; 0.1 inches to 4 inches; 0.1 inches to 3 inches; 0.1 inches to 2.5 inches; 0.1 inches to 2 inches; 0.1 inches to 1.5 inches; 0.1 inches to 1 inch; 0.1 inches to 0.5 inches; 0.25 inches to 2.5 inches; 0.25 inches to 2 inches; 0.25 inches to 1.5 inches; 0.25 inches to 1 inch; 0.25 inches to 0.5 inches; or 0.5 inches to 2 inches; 0.5 inches to 1.5 inches; or 0.5 inches to 1 inch. In an embodiment, the spacing of the indentations is 2 inches. Other indention spacing's also can be provided. For example, and without limitation, the indentations can be formed in substantially equally spaced groups, at different spacing's, or combinations thereof.

It has been found that by selection of an appropriate size, geometry, and spacing of the indentations, cracking of the shingle during handling of the shingle bundle prior to installation is reduced.

Figure 1D:
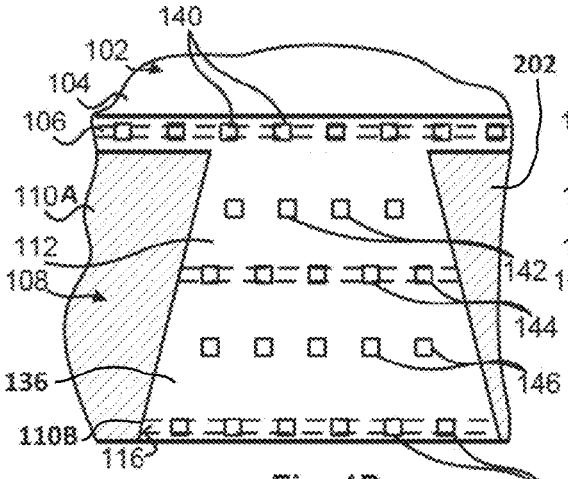
Figure 1E:
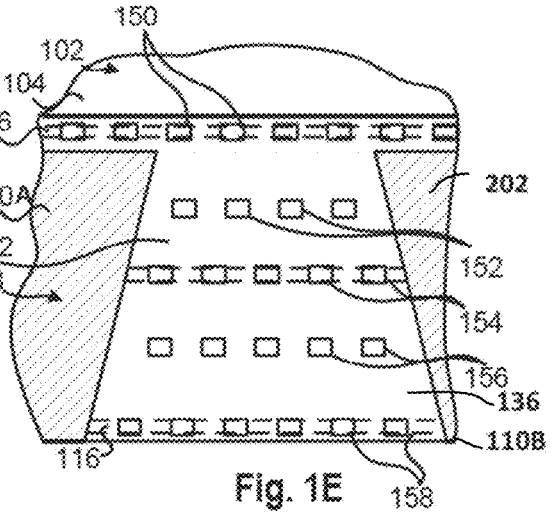
Figure 1F:
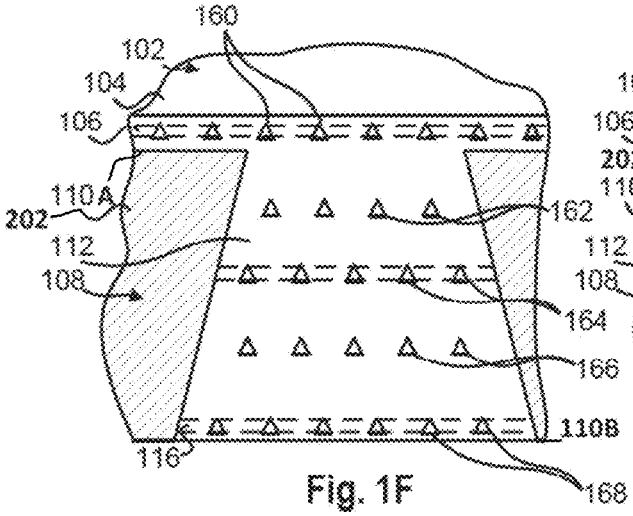
Figure 1G:
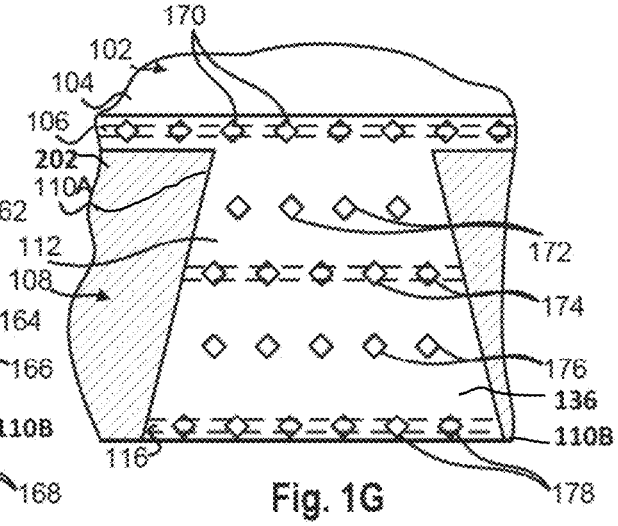
Figure 1H:
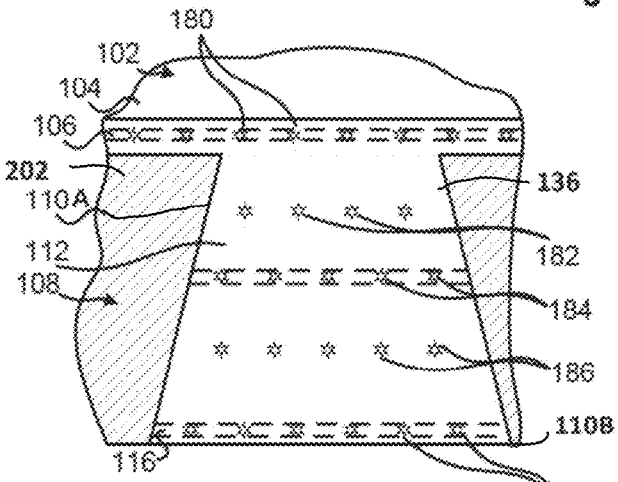

As noted, different shapes can be utilized for the indentations. As illustrated in FIG. 1D, square shaped indentations 140, 142, 144, 146, and 148 can be utilized for the roofing shingle 100. In FIG. 1E, rectangular shaped indentations 150, 152, 154, 156, and 158 can be utilized for the roofing shingle 100. In FIG. 1F, triangular shaped indentations 160, 162, 164, 166, and 168 can be utilized for the roofing shingle 100. In FIG. 1G, diamond shaped indentations 170, 172, 174, 176, and 178 can be utilized. In FIG. 1H, star shaped indentations 180, 182, 184, 186, and 188 can be utilized for the roofing shingle 100. Other shapes can be utilized. The different shapes can affect adhesion or fusion between the first layer 102 and the second layer 108. For example, the inner surface area for a star shaped indentation, as illustrated in FIG. 1H, can be greater than that of a circular shaped indentation, as illustrated in FIG. 1C of the same general size. In other embodiments, the geometry of the indentations can include a hemisphere (also referred to as a dome), half moon, rounded rectangle, rounded pin, rivet, square, rectangular or bar shapes, or combinations thereof.

Figure 2A:
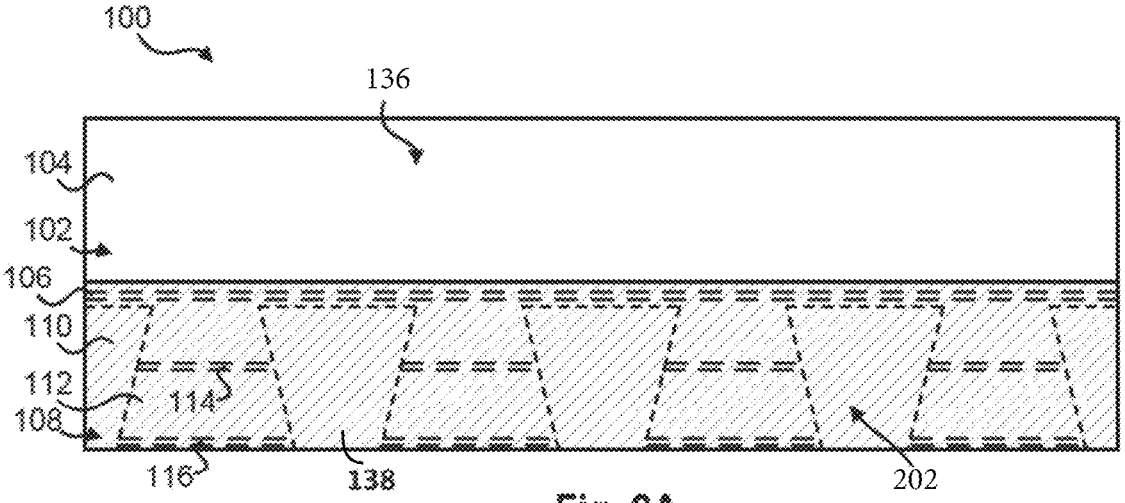
FIG. 2A, FIG. 2B, and FIG. 2C show a bottom-up view of a roofing shingle according to additional embodiments of the present disclosure.
Figure 2B:
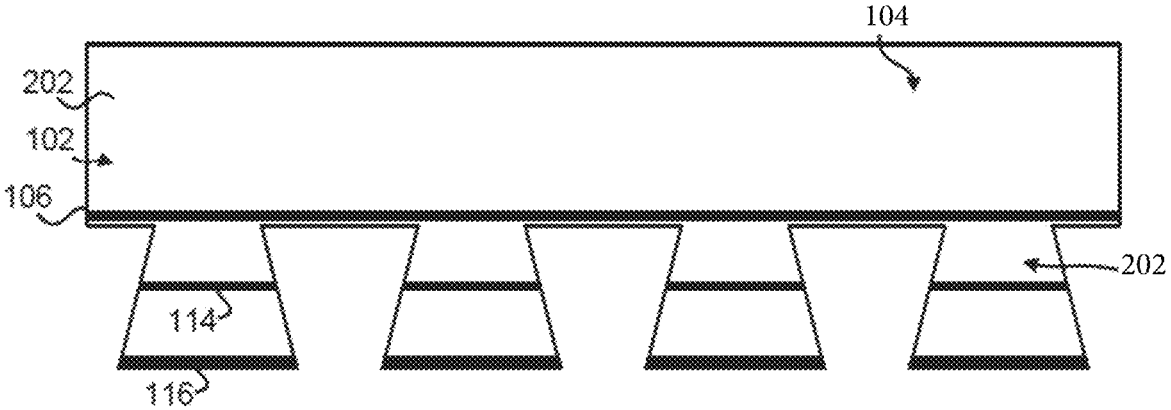
Figure 2C:
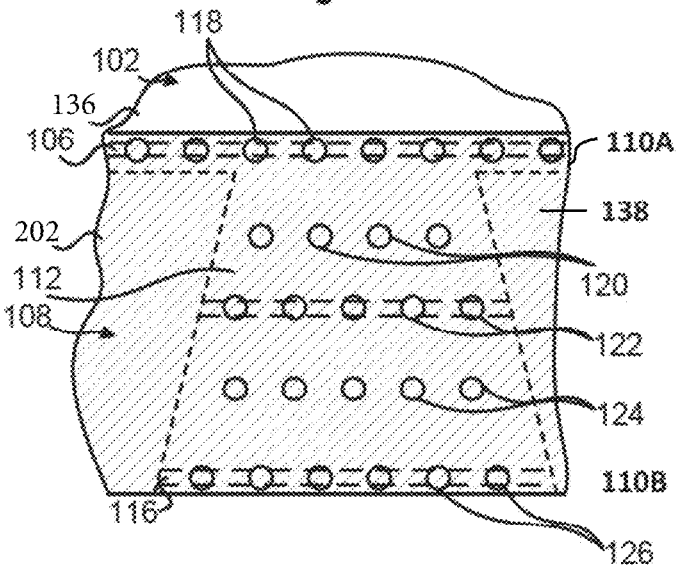

FIG. 2A, FIG. 2B, and FIG. 2C show a bottom-up view of a roofing shingle 100 according to additional embodiments of the present disclosure. The front of the second layer 108 can be applied to a rear surface or portion 202 of the first layer 102. The rear surface or portion 202 of the first layer 102 can include strips, beads, dots, or other suitable forms of adhesive applied thereto, e.g., along the common bond area; and the second layer 108 is positioned over the rear surface of the first layer 102 (e.g., the plurality of tabs and a portion of the headlap portion 104), after which the pluralities of indentations can be applied at various locations. The indentations will push through the second layer 108 and are into the first layer 102. In some embodiments, the second plurality of indentations (e.g., along the tabs) will extend through the tabs to a point so as to form raised areas or shapes that may be visible from the front of the roofing shingle 100. In another embodiment, the indentations may not be visible through front of the roofing shingle 100.

FIG. 3A and FIG. 3B show side views of various roofing shingles according to embodiments of the present disclosure, including cross-section views of indentations. As noted, the indentations may or may not be visible through the front of the shingle. For example, in FIG. 3A, the roofing shingle can include a first layer 102 and a second layer 108. The indentations 302, 304, and 306 may push through the second layer 108 and into the first layer 102. Thus, the material of the second layer 108 can be fused with the material of the first layer 108, but not be visible from the front of the roofing shingle. In FIG. 3B, the indentations 308, 310, and 312 illustrate indentations which protrude through the second layer 108 and into the first layer 102, at varying depths, including to a depth where protrusions 314, 316, and 318 are visible on the upper facing side of the tabs. Such protrusions can be of a selected shape and/or can be arranged in such a way to form aesthetic features of the roofing shingle.

FIG. 4A and FIG. 4B show perspective views of the top side and bottom side surfaces of a roofing shingle 100, according to embodiments of the disclosure. As noted, the roofing shingle 100 may include a number of indentations 402, 404, and 406. FIGS. 4A and 4B illustrates a number of indentations 402, 404, and 406. It will be understood that additional or less indentations of varying sizes and/or shapes can be utilized. In such an embodiment, the indentations are not visible through the front of the shingle. It is understood that the indentations, in other embodiments, can be seen through the top side surface of the roofing shingle 100, such as by projecting through and/or forming raised areas having a particular configuration visible along the top side surface of the roofing shingle.

FIG. 5 shows a roofing system 500 according to an embodiment of the present disclosure. FIG. 5 illustrates a number of roofing shingles 502, 504, and 506 in courses over a roof deck 508. In an embodiment, a sealant material can be utilized to install the roofing shingles 502, 504, and 506. In another embodiment, lines of sealant or sealant lines can be used, in addition to mechanical fasteners or connectors or rather than mechanical fasteners or connectors.

In an embodiment, the sealant lines are capable of aggressively attaching a shingle to other shingles and to the roof deck upon installation. Preferably, the sealant material has initial tack at low temperatures (so as to provide wind resistance during cold weather applications). In a preferred embodiment, the sealant material has adequate viscosity to resist flow at elevated temperatures (for example, above 100° F.) so as to prevent shingles from sliding off high pitch roofs at elevated temperatures. Suitable sealant materials include bitumen-based sealants, polymer-modified bitumen sealants, butyl adhesives, chloroform adhesives, acrylic adhesives, polyurethane adhesives, epoxies, solvent-based adhesives, emulsion adhesives, cyanoacrylates, and combinations thereof. In a preferred embodiment, the sealant strips are covered with a release tape that is removed prior to installation. In an embodiment, the release tape can be functionalized so that the sealant is activated upon unpacking from the shingle bundle, thus providing rapid curing upon installation. The sealant strips may be continuous, dashed or dotted and may extend across the full length of the shingle, or a part length. In an embodiment, the sealant strips extend across substantially the entire length of the shingle.

In an embodiment, the shingles are applied directly to the roof deck. The sealant may be selected to give optimal adhesion to the materials of the roof deck (for example, wood roof decks, concrete roof decks, metal roof decks, fiber cement boards, plastic composite boards, or coated surfaces), with or without the application of additional fasteners.

In another embodiment, an underlayment is present between the shingles and the roof deck. The underlayment surface may be specifically functionalized to have strong chemical affinity towards the shingle sealant materials in contact with the underlayment.

FIG. 6 schematically shows a method of forming the roofing shingles 100, including an indentation cylinder 604 engaging the first and second layers to form indentations along the tabs of the roofing shingle according to an embodiment of the present disclosure. In such embodiments, first and second layers of shingle material can be fed into the system 600. The first and second layers of shingle material will move through the system 600 along a processing path in a machine direction indicated by arrow 612. Adhesive materials will be applied to at least one of the layers of shingle material, such as along a common bond area and at spaced locations between an exposure portion of the first layer of the shingle materials and the second layer of the shingle material. The layers of shingle material will be pressed into adhesive contact or otherwise be laminated together to form a laminate web or sheet of shingle material, after which a plurality of tabs can be engaged by at least one cutter, such as one or more cutting cylinders, that cut into the first layer 102 and one or more roofing shingles can be cut from the sheet of shingle material.

The roofing shingles further will be subjected to engagement with the indentation cylinder 604 that is configured to create the pluralities of indentations, via nibs 606, or punches spaced about the indention cylinder. The indention cylinder will engage the roofing shingles with sufficient force to form the plurality of indentations, with the indentations extending to a depth and being configured to mechanically attach the second layer 108 to the first layer 102. In embodiments, the indention cylinder can be of the same circumference as the cutting cylinder that cuts and can rotate in registration with the cutting cylinder. The indentation cylinder 604 will rotate in a direction indicated by 610. The system 600 also can include another cylinder 608 to press the roofing shingle into the indentation cylinder 604.

In an embodiment, the indentation cylinder 604 is configured to create a plurality of machine direction indentations in the roofing shingle. The indentation cylinder 604 can, in addition to or rather than forming the machine direction indentations, to be configured to create a plurality of indentations in the cross-machine direction and at various spaced locations along and in registration with the areas where the tabs of the exposure portion of the first layer are adhesively attached to the second layer. The machine and cross-machine direction indentations also can be located in areas that are not in registration with the adhesive strips or dots attaching the tabs to the second layer.

After cutting and formation of the roofing shingles according to embodiments of the present disclosure has been completed, the roofing shingles can be collected and stacked for transport. For example, and not limitation, the roofing shingles can have self-seal strips applied along their bottom side surfaces, over which releases materials, such as a release tape, can be applied. The roofing shingles can be stacked with the bottom side surfaces of opposing ones of the roofing shingles of each stack facing one another. The stacks of roofing shingles can be packaged for storage and transport to a job-site for installation as part of a roof system according to the principles of the present disclosure.

In embodiments, the roofing shingles 100 formed according to the principles of the present disclosure will exhibit increased levels of bond strength between the first or upper layer of the roofing shingles and the second layer or backer such that fewer fasteners (e.g., nails) may be used to attach the roofing shingles to the roof deck as further secure the layers of the roofing shingles together, as part of a roofing system; and in embodiments, such fasteners potentially could be substantially eliminated. Shingles that require fewer fasteners for installation along the roof deck can lay flatter along the roof deck, as if a roofing shingle has any distortion within the roofing shingle, fastening the roofing shingle against the roof deck with mechanical fasteners such as nails tends to lock any such distortion in place, which can create ridges or other uneven areas along the roofing shingles. With fewer fasteners required, the shingle materials of the roofing shingles the likelihood of distortions being locked in place by such fasteners is reduced such that the roofing shingles have a greater ability to lay flat along the roof as the shingle materials thereof are heated or warmed up upon exposure to sunlight and higher temperatures.

Moreover, by adding additional indentations (e.g., at least a second plurality of indentations), the engagement of the indentations between the first and second layers of the roofing shingles can further provide frictional effects or areas of engagement between adjacent courses of the roofing shingles to help resist floating or shifting of the roofing shingles along steep sloped roofs (e.g., roofs having a slope of at least approximately 30 degrees of greater). The pluralities of indentations additionally can help provide resistance to gravity or other forces pulling down on the roofing shingles, such as due to increased snow loads.

In embodiments, the indentations also can help reduce or substantially eliminate delamination between the teeth of the exposure portion of the first layer and the second layer, as well as helping to reduce or substantially prevent the teeth from lifting up between adhesive lines and forming a sail or other surface that can catch wind, which could increase potential damage to the roofing shingles. Still further, in some applications, the roofing shingles can be formed with a number and pattern of indentations between the teeth of the exposure portion of the first layer and the second layer that can be sufficient to provide a much wider area for nailing and/or substantially reduce or potentially eliminate the need for a common bond area between the first and second layers, and thus correspondingly reduce manufacturing costs as well as reducing product weight for shipping.

In other embodiments, one or more punch mechanisms, such as the punches or nibs 606 (FIG. 6) that are moved by the indention cylinder 604 into engagement with the first and second layers of shingle material during the lamination process, can be configured to inject a molten material, e.g., a metal or similar material, through the second layer and into the first layer of shingle material. After the molten material hardens, it can function as a nail to help secure the first and second layers together. In another alternative embodiment, lines, beads, dots or strips of a molten metal material can be applied at the common bond area, instead of or in addition to, an adhesive material applied at the common bond area; and as the nibs or punches engage the first and second layers of shingle material, the nibs or punches can press or indent the metal material into the first and second layers so as to mechanically lock the second layer of shingle material, the metal material and any lines, beads, dots or strips of adhesive, and the first layer of shingle material together to form a substantially unitary laminated roofing shingle.

The present disclosure has been described herein in terms of examples that illustrate principles and aspects of the present disclosure. The skilled artisan will understand, however, that a wide gamut of additions, deletions, and modifications, both subtle and gross, may be made to the presented examples without departing from the spirit and scope of the present disclosure.

We claim:

1. A roofing shingle, comprising:

a first layer comprising:

a headlap portion configured to be overlapped by at least one additional roofing shingle arranged in a next higher course of roofing shingles; and an exposure portion having a plurality of tabs;

a second layer opposite the first layer;

a plurality of indentations formed in the first and second layers of the roofing shingle; and raised areas along the plurality of tabs of the exposure portion formed from one or more of the plurality of indentations;

wherein the plurality of indentations are configured to attach the first and second layers;

wherein one or more of the plurality of indentations are formed in registration with one or more of the plurality of tabs of the exposure portion of the first layer; and wherein the plurality of indentations comprises a first plurality of indentations formed along the first and second layers in a machine direction and in registration with a common bond area between the first and second layers; and a second plurality of indentations formed along the first and second layers in the machine direction; wherein the first plurality of indentations and the second plurality of indentations are arranged at positions spaced across the first and second layers in a cross-machine direction.

2. The roofing shingle of claim 1, wherein the plurality of indentations formed in the first and second layers comprise a circular, square, triangular, rectangular, diamond, star, or hemispherical geometry, or a combination thereof.

3. The roofing shingle of claim 1, wherein at least a portion of the raised areas define a plurality of aesthetic features visible along the exposure portion.

4. The roofing shingle of claim 1, further comprising at least one strip of adhesive applied between the first layer and the second layer along a common bond area between the first and second layers, and at least one additional strip of adhesive applied between the second layer and the plurality of tabs of the exposure portion of the first layer; wherein at least a portion of the plurality of indentations formed in the first and second layers project through the at least one additional strip of adhesive.

5. The roofing shingle of claim 4, wherein an additional portion of the plurality of indentations formed in the first and second layers are configured to extend through the at least one strip of adhesive applied between the first and second layers along the common bond area.

6. A method, comprising:

moving a substrate of roofing shingle material along a path in a machine direction, the substrate comprising a first layer and a second layer;

wherein the first layer comprises:

a headlap portion, and an exposure portion having a plurality of tabs;

forming a first plurality of indentations in the substrate in the machine direction, the first plurality of indentations configured to attach the first layer to the second layer;

forming a second plurality of indentations in the substrate in the machine direction to form raised areas that are visible along an upper surface of the exposure portion of the first layer;

wherein the second plurality of indentations are spaced from the first plurality of indentations across the substrate in a cross-machine direction, and wherein one or more of the second plurality of indentations are positioned in registration with one or more of the plurality of tabs formed in the first layer of the substrate; and cutting the substrate to form a plurality of roofing shingles.

7. The method of claim 6, wherein forming the second plurality of indentations in the substrate comprises punching circular, square, rectangular, diamond shaped, triangular shaped, or star-shaped indentations, or a combination thereof, into the substrate.

8. The method of claim 6, wherein forming the second plurality of indentations further comprises punching at least some indentations of the second plurality of indentations into the substrate to a depth sufficient to form the raised areas.

9. The method of claim 6 further comprising engaging the first layer with a cutter and cutting portions of the first layer to form the plurality of tabs along the exposure portion of the first layer; and wherein forming the second plurality of indentations comprises engaging the second layer of the substrate with a plurality of punches configured to move in registration with the cutter to form the second plurality of indentations in registration with the plurality of tabs.

10. The method of claim 6, wherein forming the first plurality of indentations and forming the second plurality of indentations comprises engaging the substrate with a plurality of punches; wherein forming the first plurality of indentations further comprises punching the first plurality of indentations through a strip of adhesive material positioned along a common bond area between the first layer and the second layer; and wherein forming the second plurality of indentations comprises punching at least some of the second plurality of indentations through at least one additional strip of an adhesive material positioned between the plurality of tabs of the first layer and the second layer.

11. The method of claim 6, wherein forming the first plurality of indentations and forming the second plurality of indentations comprises engaging the substrate with a plurality of punches, and forming at least a portion of at least one of the first plurality of indentations and the second plurality of indentations in the substrate at a position between a strip of adhesive material applied along a common bond area between the first layer and the second layer and at least one additional strip of an adhesive material applied between the plurality of tabs of the first layer and the second layer.

12. A stack of roofing shingles, comprising:

a plurality of roofing shingles, wherein at least a portion of the roofing shingles comprises:

a first layer including:

a headlap portion configured to be overlapped by at least one additional roofing shingle arranged in a next higher course of roofing shingles on a roof, and an exposure portion having a plurality of tabs;

a second layer opposite the first layer;

a plurality of indentations formed in the first and second layers and configured to attach the first and second layers together; and raised areas along the plurality of tabs of the exposure portion formed from one or more of the plurality of indentations, the plurality of indentations comprising:

a first plurality of indentations formed in a machine direction; and a second plurality of indentations formed along each roofing shingle in the machine direction and spaced from the first plurality of indentations in a cross-machine direction; and wherein at least a portion of the second plurality of indentations are located in registration with the plurality of tabs of the exposure portion.

13. The roofing shingle of claim 12, wherein at least a portion of the raised areas define a plurality of aesthetic features visible along the exposure portion.

14. The roofing shingle of claim 12, wherein the plurality of indentations formed in the first and second layers comprise a circular, square, triangular, rectangular, diamond, star, or hemispherical geometry, or a combination thereof.

15. The roofing shingle of claim 12, further comprising at least one strip of adhesive applied between the first layer and the second layer along a common bond area between the first and second layers, and at least one additional strip of adhesive applied between the second layer and the plurality of tabs of the exposure portion of the first layer; wherein at least a portion of the plurality of indentations formed in the first and second layers project through the at least one additional strip of adhesive.

16. The roofing shingle of claim 15, wherein an additional portion of the plurality of indentations formed in the first and second layers are configured to extend through the at least one strip of adhesive applied between the first and second layers along the common bond area.

17. A roofing system, comprising:

a roof deck, a plurality of roofing shingles positioned on the roof deck, at least a portion of the roofing shingles comprising:

a first layer including a headlap portion and an exposure portion, the exposure portion having a plurality of tabs, a second layer attached to the first layer; and a plurality of indentations formed in the first and second layers and aligned in a machine direction along the first and second layers; and raised areas along the plurality of tabs of the exposure portion formed from one or more of the plurality of indentations, wherein the plurality of indentations are configured to attach the first layer to the second layer;

wherein a first plurality of indentations of the plurality of indentations are positioned in registration with a common bond area defined between the first and second layers;

wherein a second plurality of indentations of the plurality of indentations are spaced from the first plurality of indentations in a cross-machine direction across the first layer and second layer and at least some of the second plurality of the indentions are positioned in registration with the plurality of tabs of the exposure portion of the first layer; and wherein the roofing shingles are arranged in overlapping courses of roofing shingles on the roof deck with the headlap portion of each roofing shingle in a lower course attached to an overlapping roofing shingle of a higher course of roofing shingles.

18. The roofing system of claim 17, wherein the plurality of indentations formed in the first and second layers comprise a circular, square, triangular, rectangular, diamond, star, or hemispherical geometry, or a combination thereof.

19. The roofing system of claim 17, further comprising at least one strip of adhesive applied between the first layer and the second layer along a common bond area between the first and second layers, and at least one additional strip of adhesive applied between the second layer and the plurality of tabs of the exposure portion of the first layer; wherein at least a portion of the plurality of indentations formed in the first and second layers project through the at least one additional strip of adhesive.

20. The roofing system of claim 17, wherein at least a portion of the raised areas define a plurality of aesthetic features visible along the exposure portion.

21. The roofing system of claim 17, wherein an additional portion of the plurality of indentations formed in the first and second layers are configured to extend through at least one strip of adhesive applied between the first and second layers along the common bond area.

22. A roofing shingle, comprising:

a first layer comprising:

a headlap portion configured to be overlapped by at least one additional roofing shingle arranged in a next higher course of roofing shingles; and an exposure portion having a plurality of tabs;

a second layer opposite the first layer;

a plurality of indentations formed in the first and second layers of the roofing shingle; and raised areas along the plurality of tabs of the exposure portion formed from one or more of the plurality of indentations, wherein the plurality of indentations are configured to attach the first and second layers;

wherein one or more of the plurality of indentations are formed in registration with one or more of the plurality of tabs of the exposure portion of the first layer;

wherein the plurality of indentations comprises a first plurality of indentations formed along the first and second layers in a machine direction and in registration with a common bond area between the first and second layers; and a second plurality of indentations formed along the first and second layers in the machine direction; wherein the first plurality of indentations and the second plurality of indentations are arranged at positions spaced across the first and second layers in a cross-machine direction; and wherein at least a portion of the raised areas define a plurality of aesthetic features visible along the exposure portion.

* * * * *